US009260170B2

(12) United States Patent
Kubo et al.

(10) Patent No.: US 9,260,170 B2
(45) Date of Patent: Feb. 16, 2016

(54) TRANSMISSION OF OUTBOARD MOTOR

(71) Applicant: SUZUKI MOTOR CORPORATION, Hamamatsu-shi, Shizuoka (JP)

(72) Inventors: Yoshiki Kubo, Hamamatsu (JP); Keisuke Daikoku, Hamamatsu (JP); Keiji Imanaga, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 14/326,917

(22) Filed: Jul. 9, 2014

(65) Prior Publication Data

US 2015/0013486 A1 Jan. 15, 2015

(30) Foreign Application Priority Data

Jul. 10, 2013 (JP) ..... 2013-144670

(51) Int. Cl.
*B63H 23/04* (2006.01)
*B63H 20/14* (2006.01)
*B63H 20/32* (2006.01)

(52) U.S. Cl.
CPC ..... *B63H 20/14* (2013.01); *B63H 20/32* (2013.01); *B63H 2020/323* (2013.01); *Y10T 74/19284* (2015.01)

(58) Field of Classification Search
CPC ..... F16H 3/091; B63H 20/002; B63H 20/14
USPC ..... 440/75; 74/325, 329
See application file for complete search history.

(56) References Cited

U.S. PATENT DOCUMENTS

| | | | | |
|---|---|---|---|---|
| 4,343,612 | A * | 8/1982 | Blanchard | 440/75 |
| 4,400,163 | A * | 8/1983 | Blanchard | 440/75 |
| 4,747,795 | A * | 5/1988 | Kawamura et al. | 440/75 |
| 7,997,398 | B1 * | 8/2011 | Phillips et al. | 192/48.604 |
| 8,996,214 | B2 * | 3/2015 | Ishii | 701/22 |
| 2013/0066496 | A1 * | 3/2013 | Ishii | 701/22 |

FOREIGN PATENT DOCUMENTS

| | | |
|---|---|---|
| JP | S60-145777 | 8/1985 |
| JP | S62-191297 | 8/1987 |
| JP | H03-14273 | 2/1991 |
| JP | H04-27757 | 7/1992 |
| JP | 2009-149202 | 7/2009 |

* cited by examiner

*Primary Examiner* — Ha D Ho
(74) *Attorney, Agent, or Firm* — Troutman Sanders LLP

(57) ABSTRACT

A transmission is structured to include a drive shaft, a counter shaft disposed in parallel with the drive shaft, a gear train bridged between each of a drive shaft input shaft and output shaft and the counter shaft, and a dog clutch mechanism selectively switching a high shift speed and a low shift speed in a transmission chamber. The transmission includes a drive device driving the dog clutch mechanism constituted of a hydraulic drive device driven by a hydraulic cylinder, the hydraulic cylinder being disposed in the transmission chamber.

5 Claims, 14 Drawing Sheets

SEC. I-I

SEC. II-II

SEC. III-III

TRANSMISSION OF OUTBOARD MOTOR

CROSS-REFERENCE TO RELATED APPLICATIONS

This application is based upon and claims the benefit of priority of the prior Japanese Patent Application No. 2013-144670, filed on Jul. 10, 2013, the entire contents of which are incorporated herein by reference.

BACKGROUND OF THE INVENTION

1. Field of the Invention

The present invention relates to a transmission in an outboard motor having a drive shaft which couples an engine in an upper part and a propeller in a lower part.

2. Description of the Related Art

Conventionally, among outboard motors in which an engine as a driving force source disposed in an upper part of an outboard motor body and a propelling device having a propeller disposed in a lower part are coupled to each other via a drive shaft, there are ones in which a transmission is provided in an appropriate middle position of the drive shaft. The transmission is shifted according to the traveling state of a boat having such an outboard motor, to an environment, or the like, so as to improve power performance, fuel consumption performance, and so on of the outboard motor.

Various types are devised as a specific structure for such transmissions. For example, in an outboard motor described in Patent Document 1, an automatic transmission made up of two planetary gears, three multiple wet clutches, and one one-way clutch is provided on a drive shaft coupling an engine and a propelling device (lower unit). According to this example, by setting the position of the transmission to a substantially middle portion in a vertical direction of the outboard motor, an outboard motor with a transmission can be realized compactly without affecting the profile of the entire outboard motor, thereby achieving both acceleration performance and fuel consumption performance.

Moreover, in one described in Patent Document 2, a two-speed transmission is constituted of parallel-axis spur gears which have high power transmission efficiency. Further, there are known one in which a switch point of the transmission is set by using a centrifugal clutch, one in which a transmission case and a water pump case are constituted integrally as in Patent Document 3, and the like.

Further, as in Patent Document 4, there is known one in which a transmission is provided in an intermediate part of a drive shaft, and an input shaft to the transmission and an output shaft from the transmission are coaxial.

Patent Document 1: Japanese Laid-open Patent Publication No. 2009-149202

Patent Document 2: Japanese Examined Patent Application Publication No. 03-14273

Patent Document 3: Japanese Examined Utility Model Application Publication No. 04-27757

Patent Document 4: Japanese Laid-open Patent Publication No. 62-191297

In one of Patent Document 1, the multiple wet clutches need a strong hydraulic device, which is expensive and for which energy needed for operating a hydraulic pump to maintain hydraulic pressure is large, becoming a cause of hindering fuel consumption performance. Further, although the multiple wet clutches couple smoothly, unlike the case of a four-wheeled vehicle, this function is not needed as much as in the case of a four-wheeled vehicle because changes in propeller speed of a propeller which only has small inertial moment are absorbed in the outboard motor. Accordingly, for the multiple wet clutches, a merit of alleviating shift shock is small with respect to high price, large weight, and large operating energy. Besides this, the planetary gears are expensive, and moreover, they are inferior to parallel-axis spur gears with respect to motive power transmission efficiency, and the like. From these points, it goes without saying that they are not suitable for outboard motors.

Further, a shift change mechanism in one of Patent Document 2 is a mechanical link mechanism, and is not able to suppress a shock transmitted to the link when it is shifted. Then, the position at an intermediate point is tolerated at a time of shift transition, and thus there is a problem of wear due to a relative speed difference. Moreover, it is set to a low speed side at a time of motive power direct coupling or to a high speed side at a time of via counter. Thus, while cruising which largely affects fuel consumption, it is motive power transmission via counter, and the fuel consumption worsens by the amount of gear transmission efficiency.

Moreover, in one of Patent Document 3, a counter shaft is disposed in a front side in a traveling direction, and a counter gear is housed in a gear case of forward tapered type, which is advantageous in terms of hydromechanics. Thus, a large-diameter gear cannot be disposed, causing a strength-related problem. Further, gear shift is performed by the mechanical link mechanism, and hence there is a problem that a shock at a time of speed shift is transmitted as is to the link side, and the like.

SUMMARY OF THE INVENTION

In view of such situations, it is an object of the present invention to provide a transmission of an outboard motor which improves power performance, fuel consumption performance, and the like, while smoothly and appropriately performing shift control.

A transmission of an outboard motor of the present invention is a transmission of an outboard motor in which a crank shaft extending in a vertical direction of an engine mounted on an upper side is coupled to a drive shaft, a gear type transmission capable of switching between at least two high and low speed ratios is interposed between a drive shaft input shaft coupled to the crank shaft and a drive shaft output shaft driving a propeller, which are separated into an upper part and a lower part of the drive shaft, wherein: the transmission is housed in a transmission chamber formed in a drive shaft housing and includes the drive shaft, a counter shaft disposed in parallel with the drive shaft, a gear train bridged between each of the drive shaft input shaft and output shaft and the counter shaft, and a dog clutch mechanism selectively switching a high shift speed and a low shift speed; and the transmission includes a drive device driving the dog clutch mechanism constituted of a hydraulic drive device driven by a hydraulic cylinder, the hydraulic cylinder being disposed in the transmission chamber.

Further, in the transmission of the outboard motor of the present invention, the drive shaft is disposed in a center portion in a left and right direction of a forefront part of the transmission chamber, and the counter shaft and the hydraulic cylinder are offset to left and right, respectively, behind the drive shaft and disposed in a triangle shape in plan view.

Further, in the transmission of the outboard motor of the present invention, the dog clutch mechanism of the transmission is structured to switch between a high shift speed and a low shift speed by a dog clutch thereof sliding up and down, and a lower engagement position of the dog clutch is set to the low shift speed.

Further, in the transmission of the outboard motor of the present invention, the hydraulic drive device has an electric hydraulic pump, and component members including the hydraulic pump and an electromagnetic changeover valve excluding the hydraulic cylinder are disposed on a hull side outside the outboard motor.

Further, in the transmission of the outboard motor of the present invention, the dog clutch mechanism of the transmission is structured such that a dog clutch thereof moves to an upper engagement position and a lower engagement position via a slide yoke, and a detent device is provided which retains a moving position of at least the slide yoke to the upper engagement position.

Further, in the transmission of the outboard motor of the present invention, each gear constituting the gear train is constituted of a helical gear; and a twist angle of the helical gear is set so that thrust reactive forces operating on gears meshing between the drive shaft input shaft and the counter shaft and on gears meshing between the drive shaft output shaft and the counter shaft counter each other.

DETAILED DESCRIPTION OF THE PREFERRED EMBODIMENTS

Hereinafter, a preferred embodiment of a transmission of an outboard motor according to the present invention will be described with reference to drawings.

Figure 1:
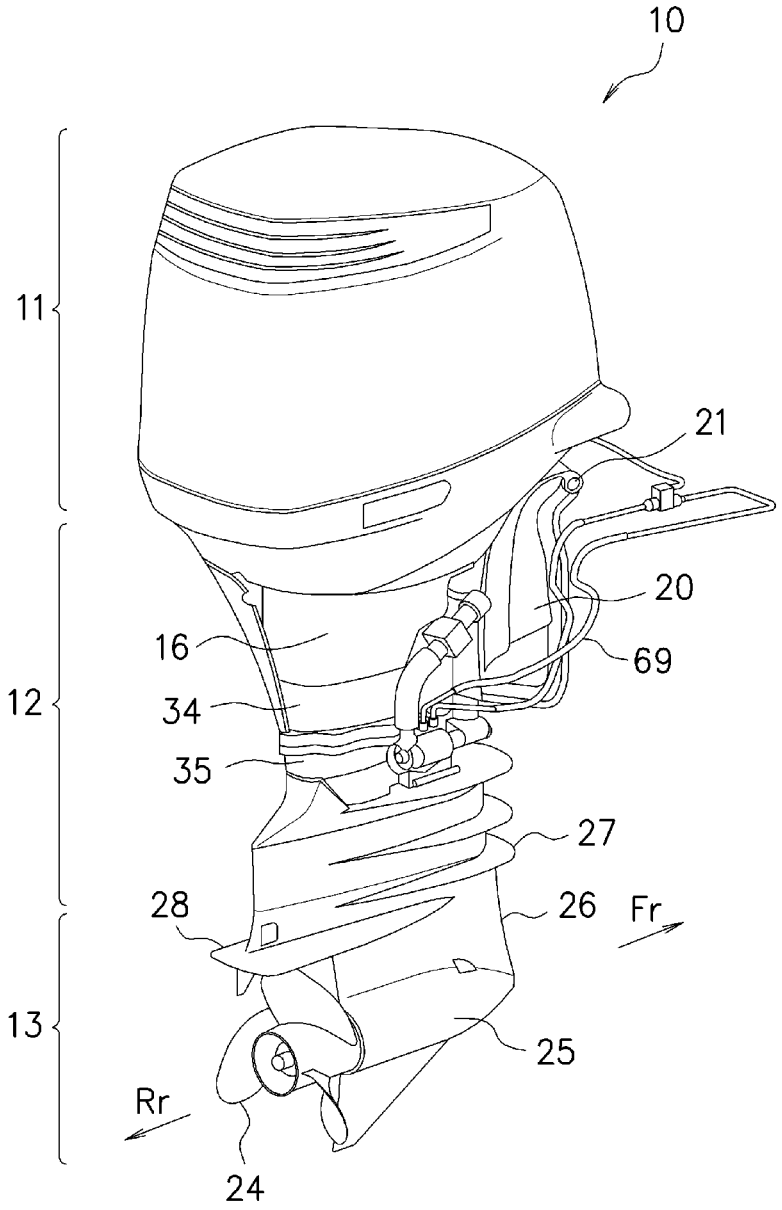
FIG. 1 is a rear perspective view illustrating an outboard motor according to the present invention.
Figure 2:
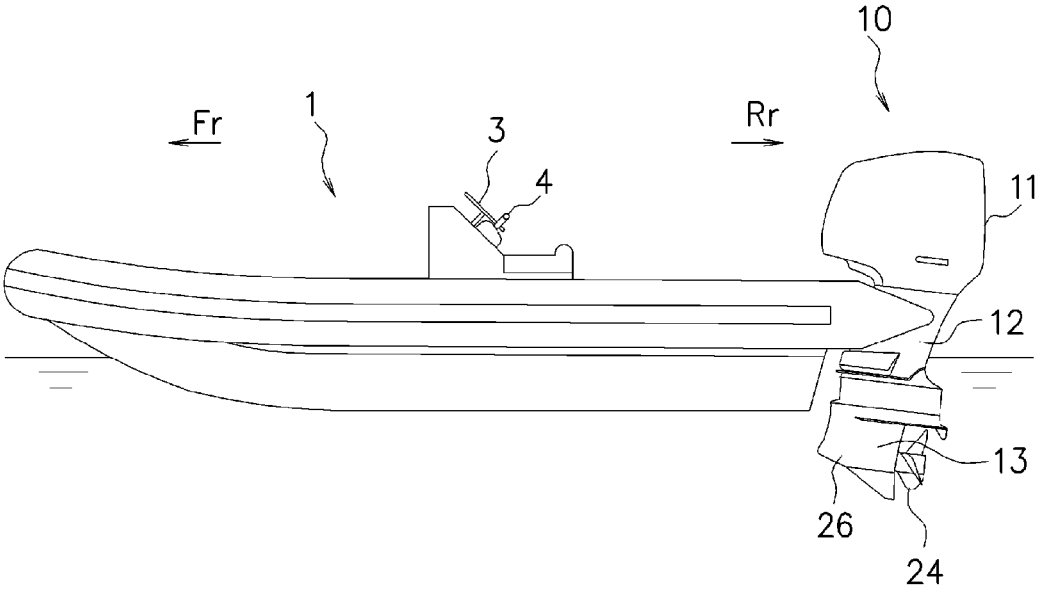
FIG. 2 is a left side view of a boat on which the outboard motor according to the present invention is mounted.
Figure 3:
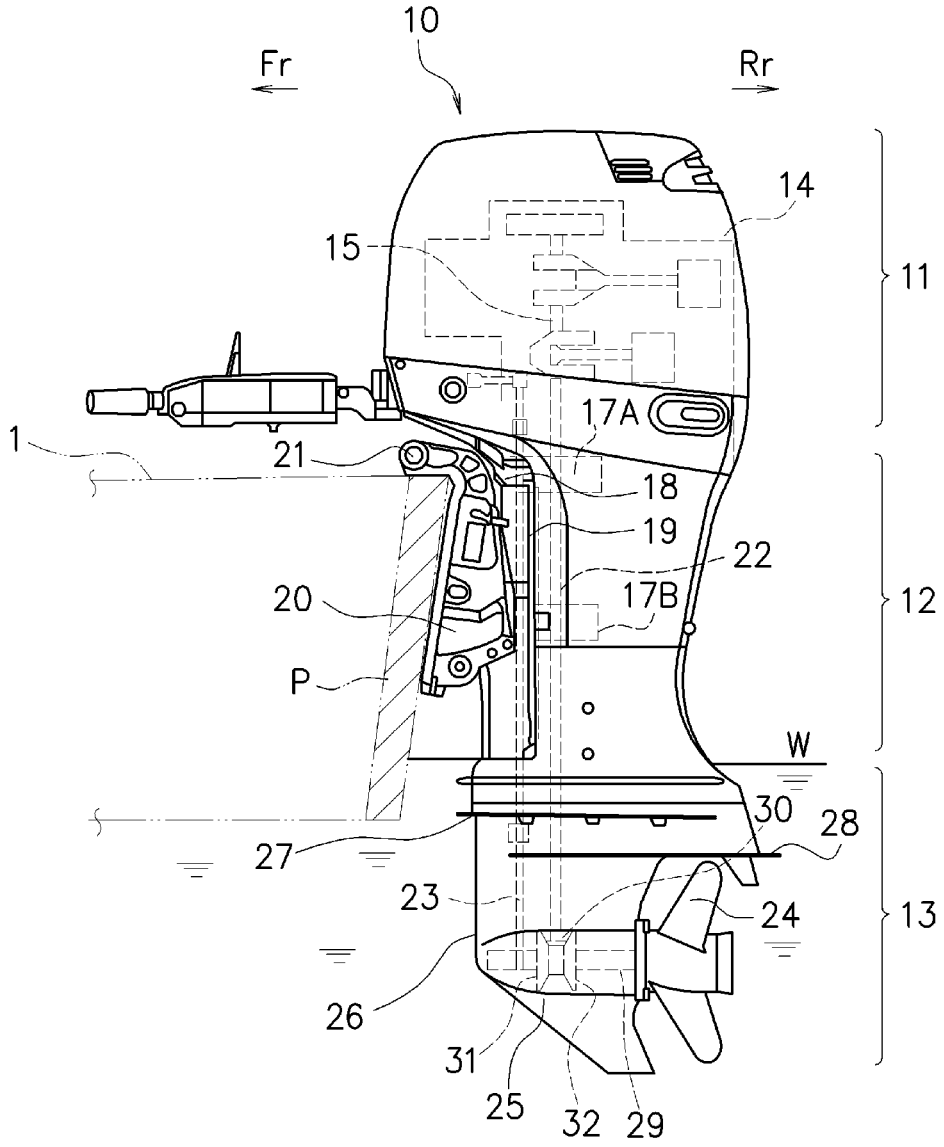
FIG. 3 is a left side view illustrating a schematic structural example of the outboard motor according to the present invention.

FIG. 1 is a rear perspective view illustrating a partially cutaway exterior of an outboard motor 10 according to the present invention. The outboard motor 10 is mounted in a rear part of the hull of a boat 1 as illustrated in FIG. 2, and in this case, at its front side, it is fixed to a stern board P of the hull of the boat 1 as illustrated in FIG. 3. Note that FIG. 3 is a left side view illustrating a schematic structural example of the outboard motor 10, and in the following description, in each drawing as necessary, the front side of the outboard motor 10 is denoted by an arrow Fr and the rear side is denoted by an arrow Rr, and further the lateral right side of the outboard motor 10 is denoted by an arrow R and the lateral left side is denoted by an arrow L.

First, the overall basic structure of the outboard motor 10 will be described. In FIG. 1 and particularly FIG. 3, an engine unit or a power unit 11, a mid unit 12, and a lower unit 13 are disposed in order from an upper part to a lower part, and these units are structured to be integrally coupled. In the engine unit 11, the engine 14 is mounted and supported vertically so that a crank shaft 15 is directed toward a vertical direction via an engine base or an engine holder. Note that as the engine 14, for example, a V-multiple cylinder engine or the like is chosen. Although the vicinity of the engine unit 11 and the mid unit 12 is covered with an exterior cover as illustrated in FIG. 1, FIG. 1 illustrates a state that part of the exterior cover of the mid unit 12 is virtually cutaway, and a drive shaft which will be described later is disposed in a drive shaft housing 16 which is schematically illustrated. Note that the engine 14 is mounted in an upper part of the drive shaft housing 16.

The mid unit 12 is supported integrally pivotally about a support shaft 19 (steering shaft) set to a swivel bracket 18 via an upper mount 17A and a lower mount 17B. A clamp bracket 20 is provided on both left and right sides of the swivel bracket 18, and it is fixed to the stern board P of the hull via this clamp bracket 20. The swivel bracket 18 is supported pivotally in a vertical direction about a support shaft 21 (tilt shaft) set in a left and right horizontal direction.

In the mid unit 12, a drive shaft 22 coupled to a lower end of the crank shaft 15 is disposed to penetrate in a vertical direction, and a driving force of this drive shaft 22 is transmitted to a propeller shaft which will be described later in a gear case of the lower unit 13. On a front side of the drive shaft 22, a shift rod 23 for switching forward and reverse, or the like is disposed in parallel in the vertical direction. The mid unit 12 has a drive shaft housing 16 which houses the drive shaft 22.

The lower unit 13 has a gear case 25 including a plurality of gears and so on for rotary driving a propeller 24 by the driving force of the drive shaft 22. The drive shaft 22 extending out downward from the mid unit 12 finally rotates the propeller 24 by meshing of a gear attached to it with a gear in the gear case 25, where a motive power transmission path in the gear device in the gear case 25 is switched, that is, shifted by operation of the shift rod 23. Further, an integrally formed casing 26 has an anti-splash plate 27 and an anti-cavitation plate 28, which are disposed vertically in the vicinity of a coupling surface with the mid unit 12, and on a lower part of the casing 26 extending downward from them, the gear case 25 disposed to exhibit a bullet shape or an artillery shell shape in a forward and backward direction is disposed.

The shift rod 23 is vertically inserted and supported in a tip side of the artillery shell shape of the gear case 25 in the casing 26. The shift rod 23 is suspended down to the position where it crosses an axial extension line of the propeller shaft 29. Further, in the vicinity of a substantially center in the forward and backward direction of the casing 26, the drive shaft 22 is inserted and supported. In the gear case 25, the propeller shaft 29 is disposed along the forward and backward direction and is rotatably supported via a plurality of bearings. On a lower end of the drive shaft 22, a drive gear 30 is attached, and on the propeller shaft 29, a front and rear pair of a forward gear 31 and a reverse gear 32 meshing with the drive gear 30 are each supported rotatably.

By a shift operation via the shift rod 23, a motive power transmission path from a forward gear 31 or reverse gear 32 to the propeller shaft 29 is formed. By start of the engine 14, output torque thereof is transmitted from the drive shaft 22 to a propelling device. That is, the outboard motor 10 generates a propulsive force by rotation of the propeller shaft 29 and the propeller 24 via the forward gear 31 or the reverse gear 32, and therefore the boat 1 in which it is mounted goes forward or backward.

Figure 4:
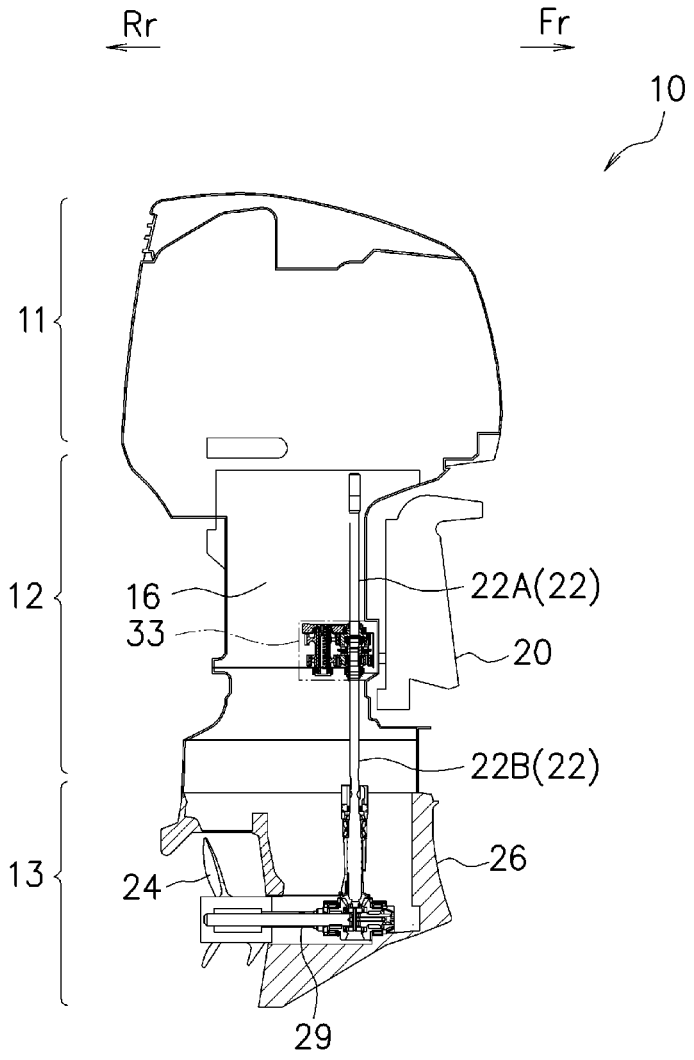
FIG. 4 is a cross-sectional view illustrating a disposition structure example of a transmission in the outboard motor according to the present invention.

In the outboard motor 10 having the above-described basic structure, in the mid unit 12 as illustrated in FIG. 4, the drive shaft 22 coupled to the lower end of the crank shaft 15 is disposed to penetrate in the vertical direction, and this drive shaft 22 is further coupled to the propeller shaft 29 in the gear case 25 of the lower unit 13. Particularly in the present invention, as in FIG. 4, the drive shaft 22 is separated vertically into a drive shaft input shaft 22A coupled to the crank shaft 15 and a drive shaft output shaft 22B driving the propeller 24. A gear type transmission 33 capable of switching between at least two high and low speed ratios is interposed between the drive shaft input shaft 22A and the drive shaft output shaft 22B.

Figure 5:
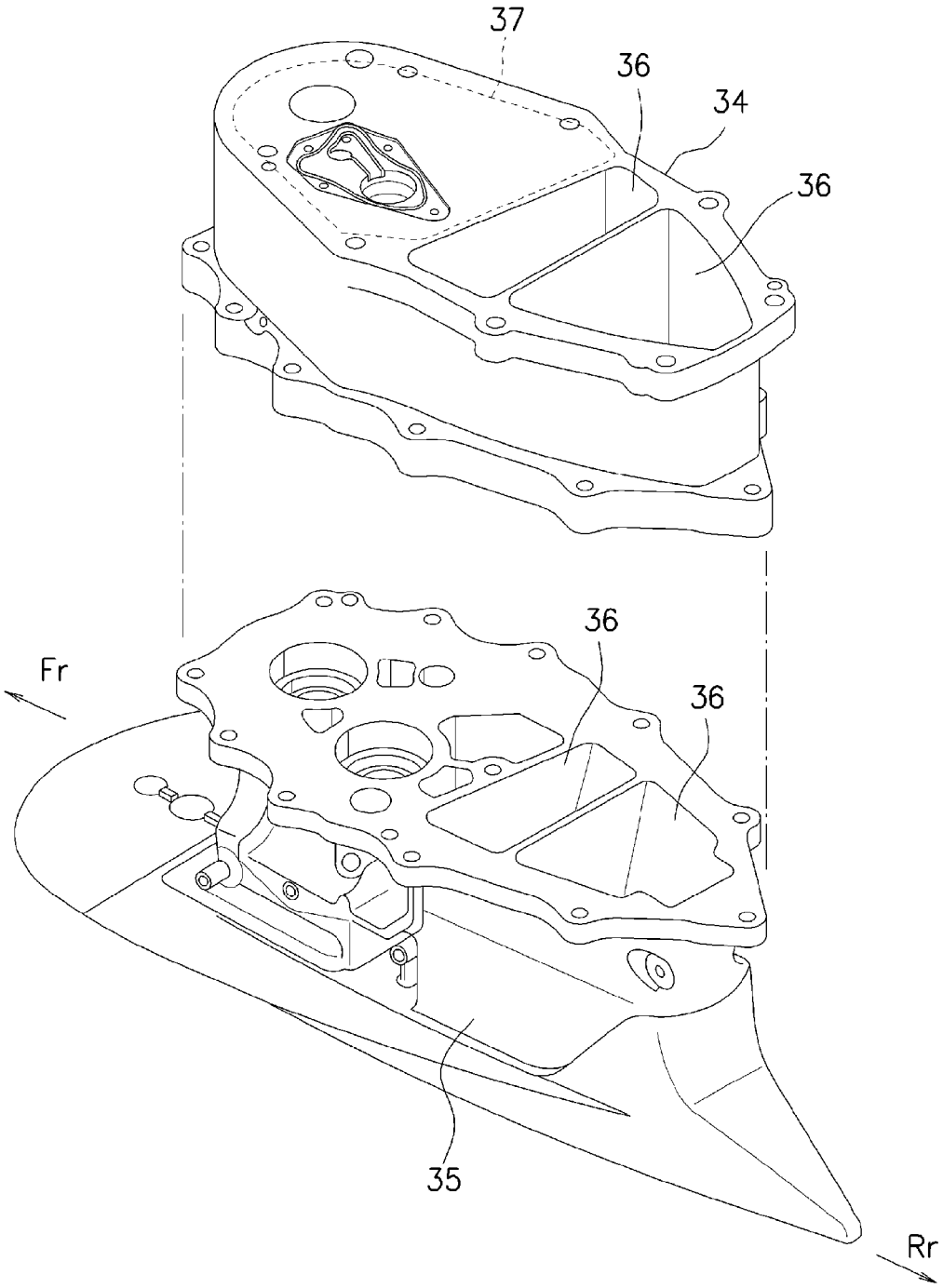
FIG. 5 is an exploded perspective view illustrating cases of the transmission in the outboard motor according to the present invention.

Below the drive shaft housing 16 in the mid unit 12, an upper case 34 and a lower case 35 for forming a transmission chamber 37, which will be described later, of the transmission 33 are integrally coupled to each other. The upper case 34 is coupled to the drive shaft housing 16, and the lower case 35 is coupled to the lower unit 13. FIG. 5 illustrates a specific structural example of the upper case 34 and the lower case 35, and the both cases are stacked vertically and have mainly in a front half part of the upper case 34 a space for forming the transmission chamber 37 of the transmission 33. Note that in a rear half part of the upper case 34 and the lower case 35, there is formed an exhaust passage 36 for allowing exhaust gas discharged from the engine 14 disposed above to flow to the lower unit 13 side below and be discharged. Here, the upper case 34 and the lower case 35 are formed separately from the drive shaft housing 16 but substantially function as part of the drive shaft housing 16, and therefore the transmission 33 itself may also be disposed and structured in the drive shaft housing 16.

Figure 6:
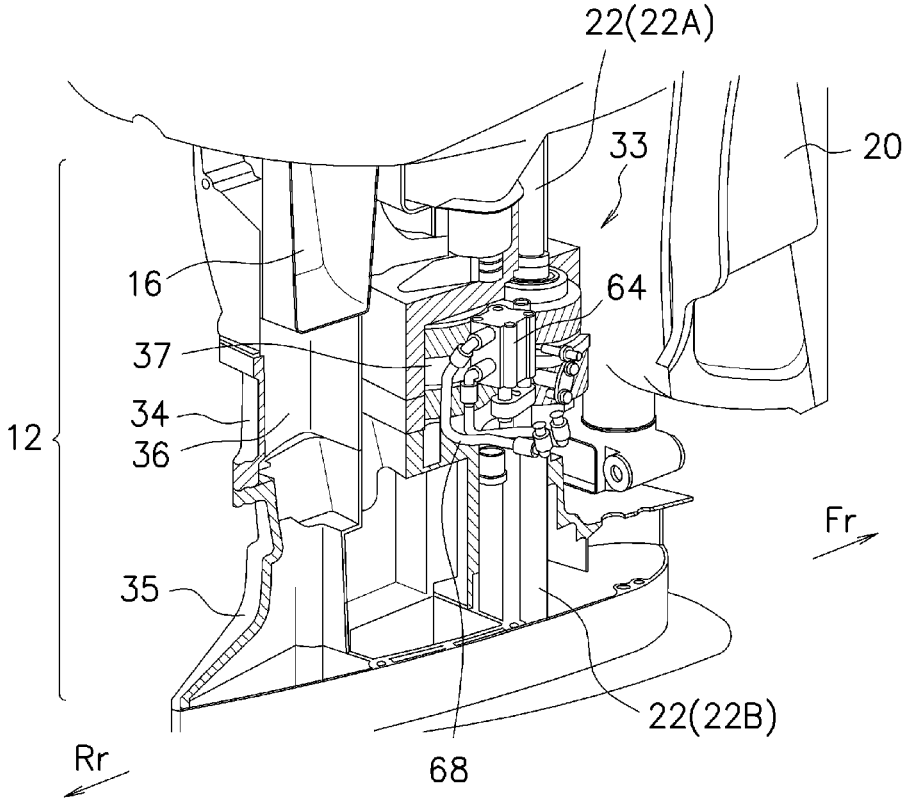
FIG. 6 is a cutaway perspective view illustrating the transmission disposed and structured in a mid unit in the outboard motor according to the present invention.
Figure 7:
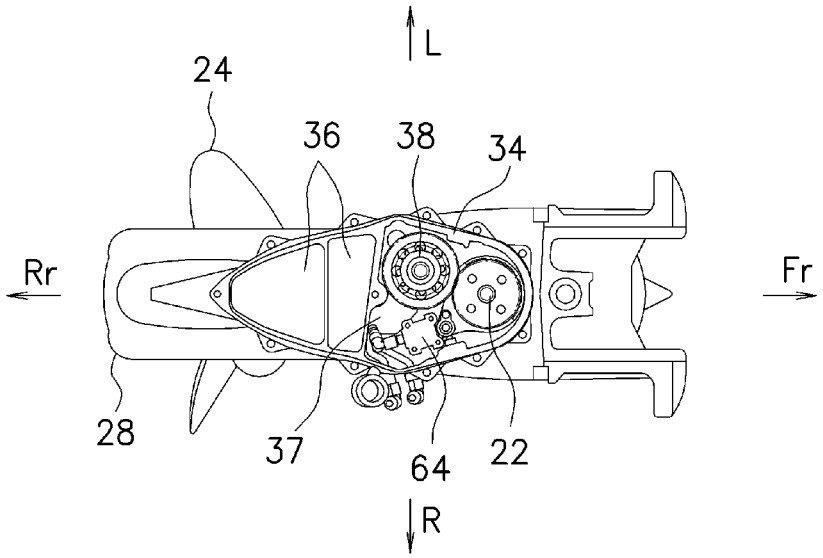
FIG. 7 is a transverse cross-sectional view of a transmission chamber in the outboard motor according to the present invention.

FIG. 6 is a cutaway perspective view illustrating the transmission 33 constituted in the upper case 34 and the lower case 35 by removing an exterior cover around the mid unit 12. As described above, in the upper case 34 and the lower case 35 coupled integrally, the transmission chamber 37 of the transmission 33 is formed, and in this transmission chamber 37, a plurality of component members of the transmission 33 are housed and disposed. The inside of the transmission chamber 37 is of a liquid-tight structure. FIG. 7 illustrates a side cross section of the transmission chamber 37, the transmission chamber 37 is disposed in the front half part of the upper case 34, and the exhaust passage 36 is formed in the rear half part thereof.

Figure 8:
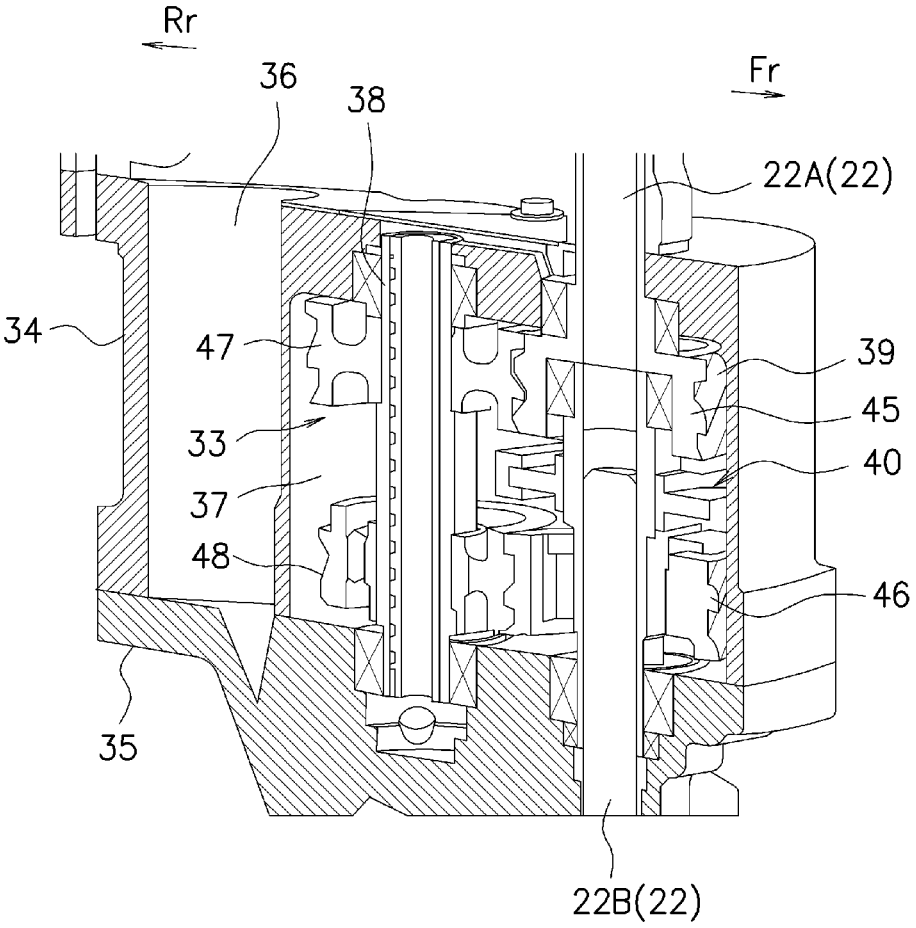
FIG. 8 is a cutaway perspective view of the transmission in the outboard motor according to the present invention.

The transmission 33 will be further described specifically using FIG. 8 and so on. The transmission 33 is housed in the transmission chamber 37 and includes a counter shaft 38 disposed in parallel with the drive shaft 22, a gear train 39 bridged between each of the drive shaft input shaft 22A and the drive shaft output shaft 22B of the drive shaft 22 and the counter shaft 38, and a dog clutch mechanism 40 capable of selectively switching a high shift speed and a low shift speed.

Particularly, a drive device 63 which will be described later driving the dog clutch mechanism 40 is constituted of a hydraulic drive device driven by a hydraulic cylinder, and this hydraulic cylinder is disposed in the transmission chamber 37.

Figure 9:
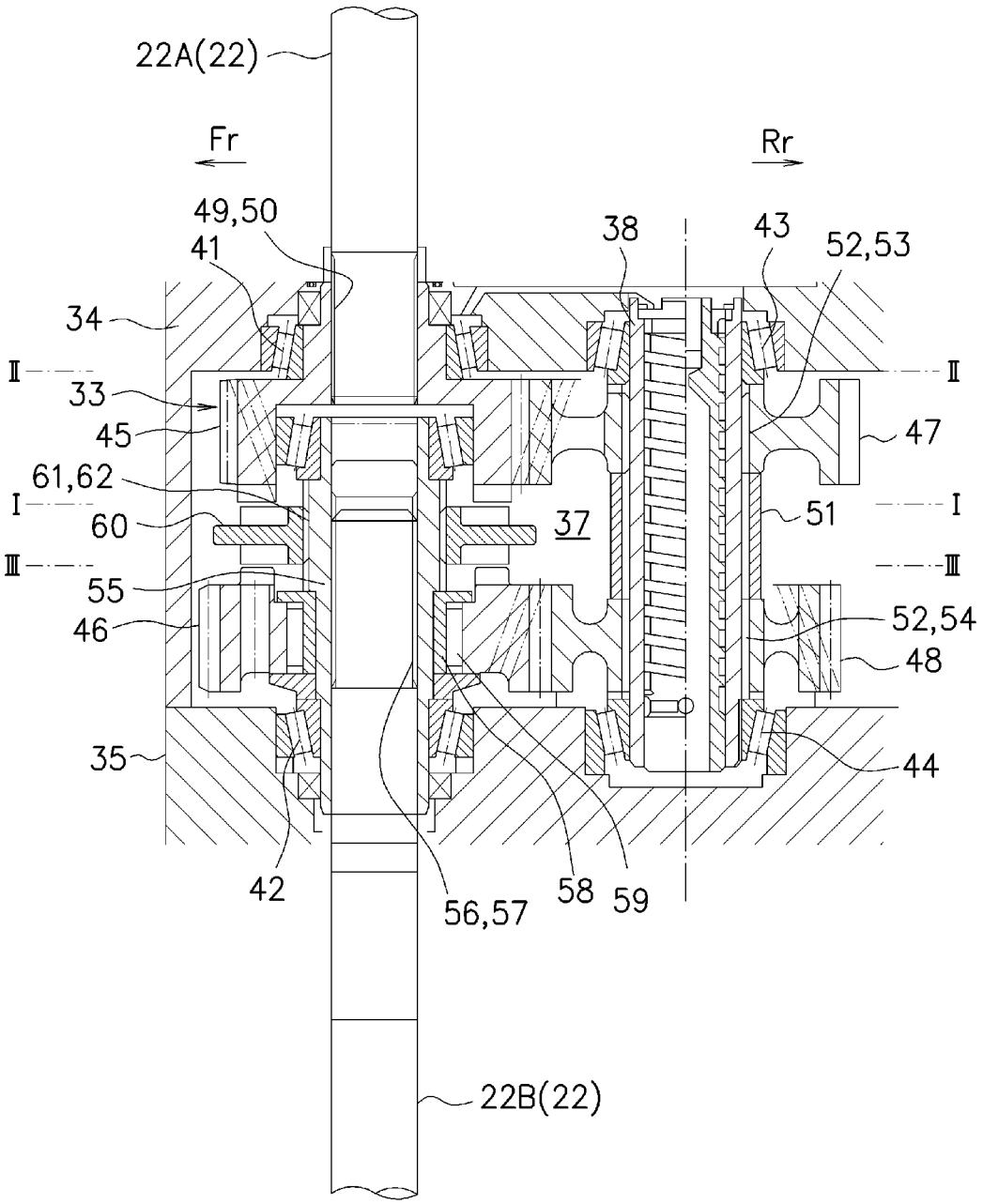
FIG. 9 is a vertical cross-sectional view of the transmission in the outboard motor according to the present invention.

With further reference to FIG. 9, the drive shaft input shaft 22A is inserted from above into a substantially center part in a left and right direction near a front side of the transmission chamber 37, and supported rotatably at its lower end on the upper case 34 indirectly via a bearing 41 (which means a tapered roller bearing unless otherwise mentioned). At a position immediately below the drive shaft input shaft 22A, the drive shaft output shaft 22B is supported rotatably at its upper end on the lower case 35 indirectly via a bearing 42. Further, the counter shaft 38 is supported rotatably at its upper and lower ends on the upper case 34 and the lower case 35, respectively, via bearings 43, 44.

The gear train 39 includes a main drive gear 45 provided integrally rotatably on the drive shaft input shaft 22A, a main driven gear 46 axially supported rotatably on the drive shaft output shaft 22B, a counter driven gear 47 meshing with the main drive gear 45 and provided integrally rotatably on the counter shaft 38, and a counter drive gear 48 provided integrally rotatably on the counter shaft 38 and meshing with the main driven gear 46.

A spline (male) 49 formed in the lower end of the drive shaft input shaft 22A and a spline (female) 50 formed in a boss part of the main drive gear 45 engage with each other, by which the drive shaft input shaft 22A and the main drive gear 45 are coupled integrally rotatably. Further, a spacer 51 is interposed between the counter driven gear 47 and the counter drive gear 48, restricting an interval between both the gears, that is, a vertical direction position. Splines (male) 52 are formed in the portions corresponding to the counter driven gear 47 and the counter drive gear 48 of the counter shaft 38, splines (female) 53, 54 are formed in the counter driven gear 47 and the counter drive gear 48, respectively, and these splines 52 and 53, 54 engage with each other, by which the counter shaft 38 and the counter driven gear 47 or the counter drive gear 48 are coupled integrally rotatably. Accordingly, the gear train 39 constituted of the main drive gear 45, the counter driven gear 47, the counter drive gear 48, and the main driven gear 46 is retained in a constantly connected state.

A hollow idle shaft 55 is externally fitted to the upper end of the drive shaft output shaft 22B, and in this case a spline (male) 56 formed in the drive shaft output shaft 22B and a spline (female) 57 formed in the idle shaft 55 engage with each other, by which the drive shaft output shaft 22B and the idle shaft 55 are coupled integrally rotatably. Further, a bearing (needle bearing) 59 is fitted between an inner sleeve 58 externally fitted to the idle shaft 55 and the main driven gear 46, and the main driven gear 46 is rotatable in relation with the drive shaft output shaft 22B.

Each gear of the gear train 39 is constituted of a helical gear. In this case, a helix angle of the helical gear is set so that a thrust reactive force operating on the mutually engaged main drive gear 45 and counter driven gear 47 and a thrust reactive force operating on the mutually engaged main driven gear 46 and counter drive gear 48 counter each other.

Further, given that a gear ratio between the main drive gear 45 and the counter driven gear 47 is $Gr_1$ and a gear ratio between the main driven gear 46 and the counter drive gear 48 is $Gr_2$, the speed reducing ratio R in the entire gear train 39 is $Gr_1 \times Gr_2$.

The dog clutch mechanism 40 has a dog clutch 60 externally fitted with the idle shaft 55 and supported vertically reciprocatably along an axial direction of the idle shaft 55 between the main drive gear 45 and the main driven gear 46.

A spline (male) 61 formed in the idle shaft 55 and a spline (female) 62 formed in the dog clutch 60 engage with each other, by which the idle shaft 55 and the dog clutch 60 are coupled integrally rotatably. As described above, the drive shaft output shaft 22B and the idle shaft 55 are coupled integrally rotatably, and therefore the three parts of the dog clutch 60, the idle shaft 55, and the drive shaft output shaft 22B couple integrally rotatably.

A drive device vertically moving the dog clutch 60, which will be described later, moves upward to engage with the main drive gear 45 (upper engagement position) and moves downward to engage with the main driven gear 46 (lower engagement position). Then, the transmission 33 is structured to switch between a high shift speed and a low shift speed by the dog clutch 60 sliding up and down, and a lower engagement position of the dog clutch 60 is set to the low shift speed. In FIG. 9, a neutral position of the dog clutch 60 is illustrated, from which the dog clutch 60 engages with the main drive gear 45 by moving upward, and in this case, the drive shaft input shaft 22A and the drive shaft output shaft 22B are directly coupled via the main drive gear 45 and the dog clutch 60. Further, by the dog clutch 60 moving downward, the dog clutch 60 engages with the main driven gear 46, and in this case, the drive shaft input shaft 22A and the drive shaft output shaft 22B are connected at the speed reducing ratio R via the motive power transmission path formed through the main drive gear 45, the counter driven gear 47, the counter drive gear 48, and the main driven gear 46.

Figure 10:
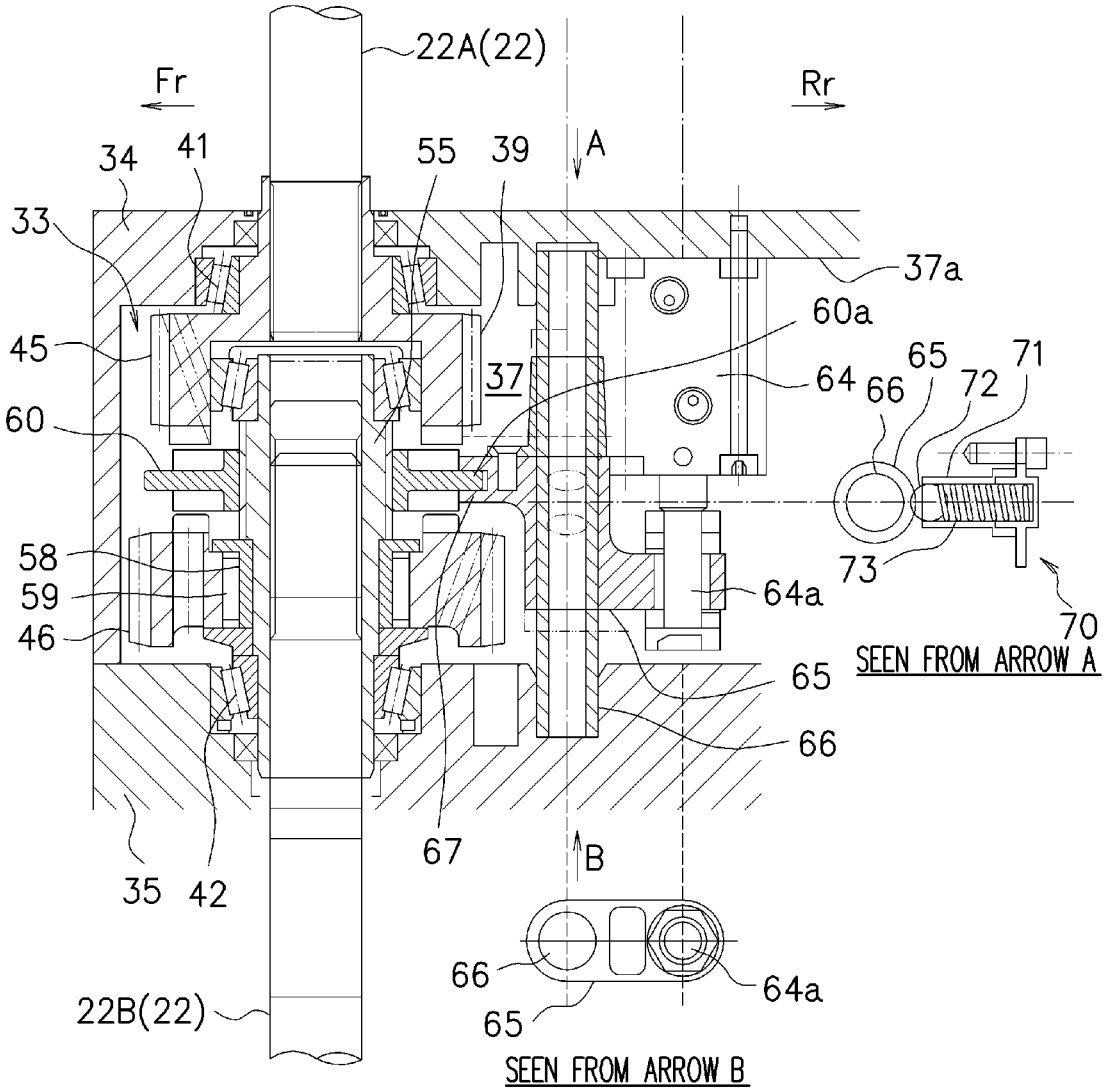
FIG. 10 is a vertical cross-sectional view of the transmission in the outboard motor according to the present invention.

The drive device 63 of the transmission 33 is constituted of a hydraulic drive device driven by a hydraulic cylinder. This hydraulic drive device includes an electric hydraulic pump, and the hydraulic cylinder is actuated by hydraulic pressure generated by this hydraulic pump. As illustrated in FIG. 10, the drive device has a hydraulic cylinder 64 whose cylinder axis is set in the vertical direction, and in this example, a cylinder body of the hydraulic cylinder 64 is fixedly supported to a ceiling part 37*a* of the transmission chamber 37. The hydraulic cylinder 64 and the dog clutch 60 are coupled via a slide yoke 65 disposed between them. In this case, the slide yoke 65 is supported vertically slidably along a guide shaft 66 suspended in the transmission chamber 37, and one end side is coupled to an output rod 64*a* of the hydraulic cylinder 64. Thus, the slide yoke 65 is moved up and down by the hydraulic cylinder 64.

Figure 11:
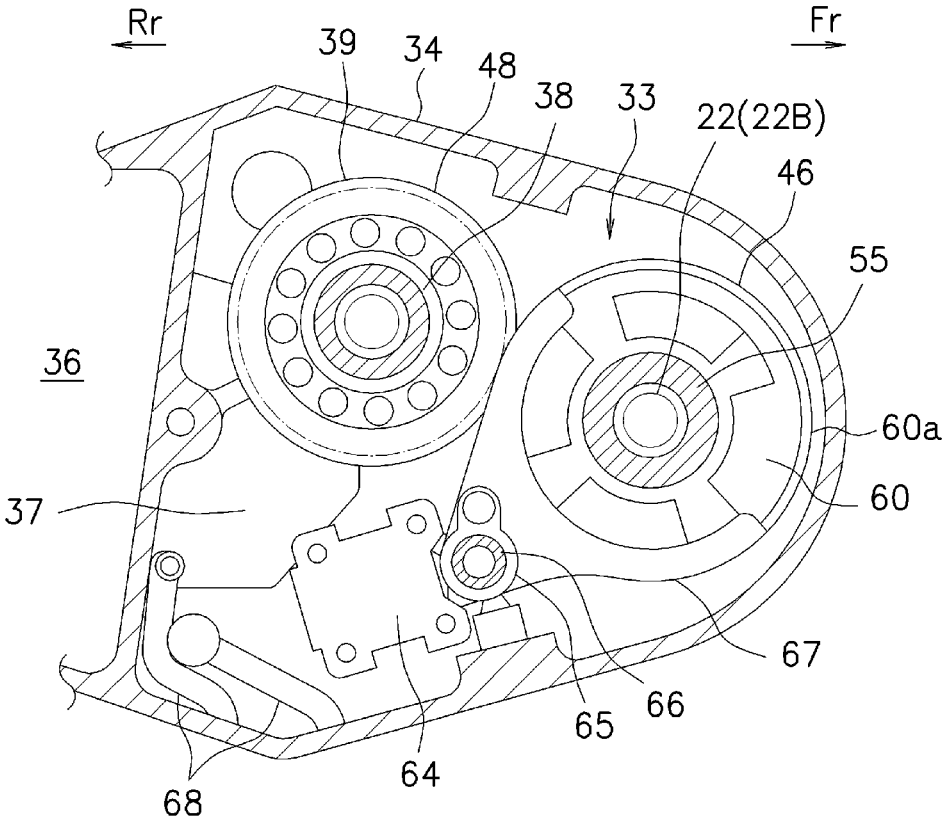
FIG. 11 is a cross-sectional view along a line I-I of FIG. 9.

Further, a shift fork 67 is attached to the other end side of the slide yoke 65, and this shift fork 67 extends out to the dog clutch 60 side to engage therewith. Specifically, the dog clutch 60 exhibits a substantially circular shape in plan view as illustrated in FIG. 11 and so on, and a flange part 60*a* is provided to project along an outer peripheral edge thereof as in FIG. 10 and FIG. 11. The shift fork 67 exhibits an arc shape in a plan view as illustrated in FIG. 11, and engages with the flange part 60*a* so as to sandwich it from both upper and lower sides (FIG. 10).

Figure 12:
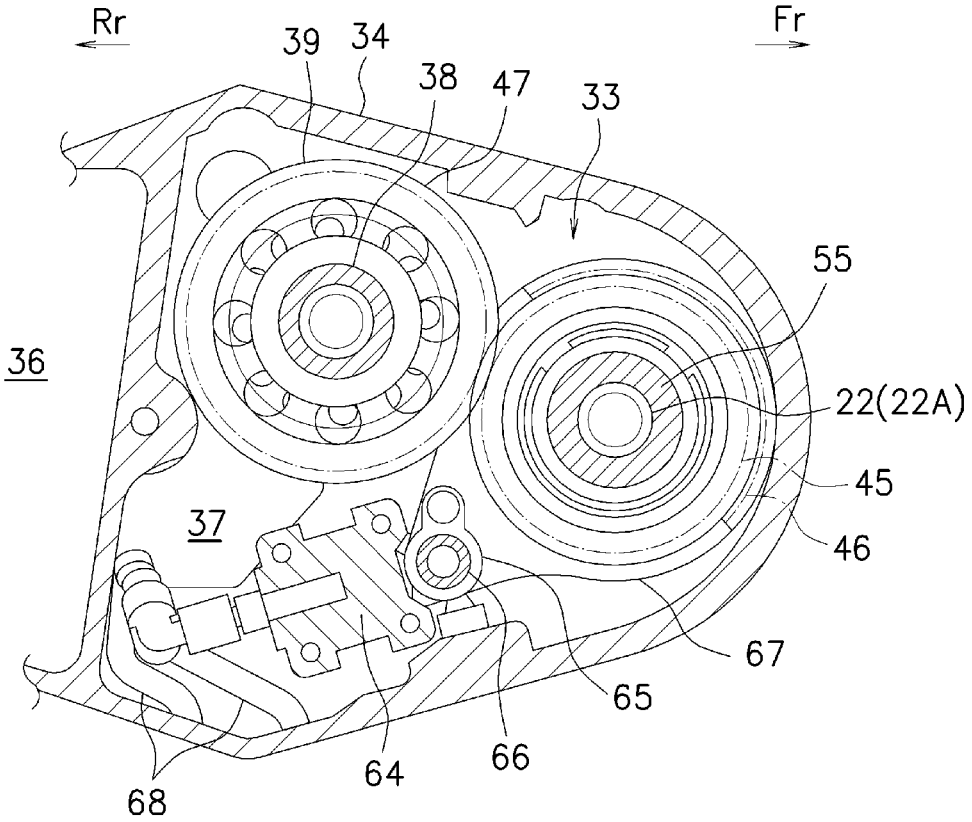
FIG. 12 is a cross-sectional view along a line II-II of FIG. 9.

Here, as illustrated in FIG. 11 or FIG. 12, the drive shaft 22 (the drive shaft input shaft 22A and the drive shaft output shaft 22B) is disposed in a center portion in the left and right direction of a forefront part of the transmission chamber 37. Further, the counter shaft 38 and the hydraulic cylinder 64 are offset to left and right, respectively, behind the drive shaft 22 and disposed in a triangle shape in plan view. That is, the three parts of the drive shaft 22, the counter shaft 38, and the hydraulic cylinder 64 are in a disposition relation not aligning straight in the forward and backward direction or the left and right direction.

A hydraulic piping 68 is connected to the hydraulic cylinder 64 as in FIG. 6, and pressure oil flows into or out of the hydraulic cylinder 64 via the hydraulic piping 68. The hydraulic piping 68 in the immediate vicinity of the hydraulic cylinder 64 is housed in the exterior cover, but an electric hydraulic pump, an electromagnetic changeover valve, and the like excluding the hydraulic cylinder 64 in the drive device 63 of the transmission 33 are disposed outside the outboard motor 10, that is, on the hull side of the boat 1. In this case, the hydraulic piping 68 and the hydraulic pump on the hull side are connected via hydraulic hoses 69 illustrated in FIG. 1.

Figure 13:
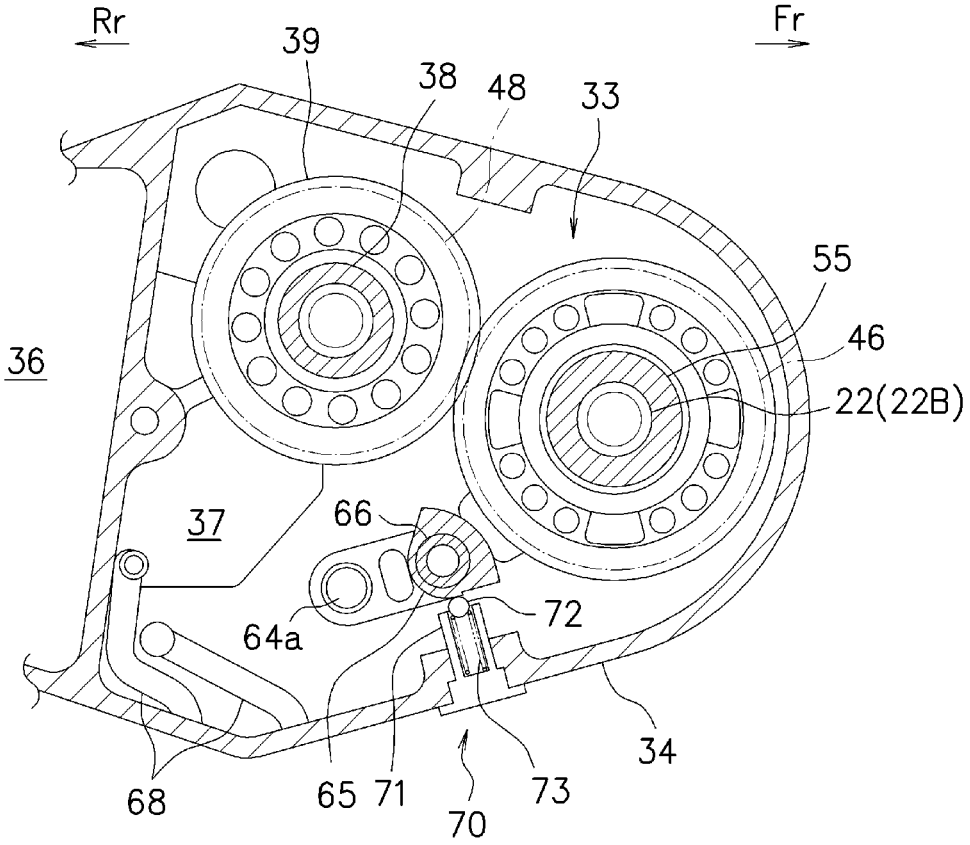
FIG. 13 is a cross-sectional view along a line III-III of FIG. 9.

In the transmission 33, a detent device 70 can be provided which retains the moving position of at least the slide yoke 65 to an upper engagement position of the dog clutch 60, as illustrated in FIG. 13. With reference also to FIG. 10 (seen from arrow A), the detent device 70 has a detent holder 71 fixed to a wall side of the upper case 34 and provided to project to the slide yoke 65 side, and a ball 72 attached to this detent holder 71 is in resilient contact with an outside surface of the slide yoke 65 by resilience of a spring 73. Note that this detent device 70 can be provided selectively as necessary.

Figure 14:
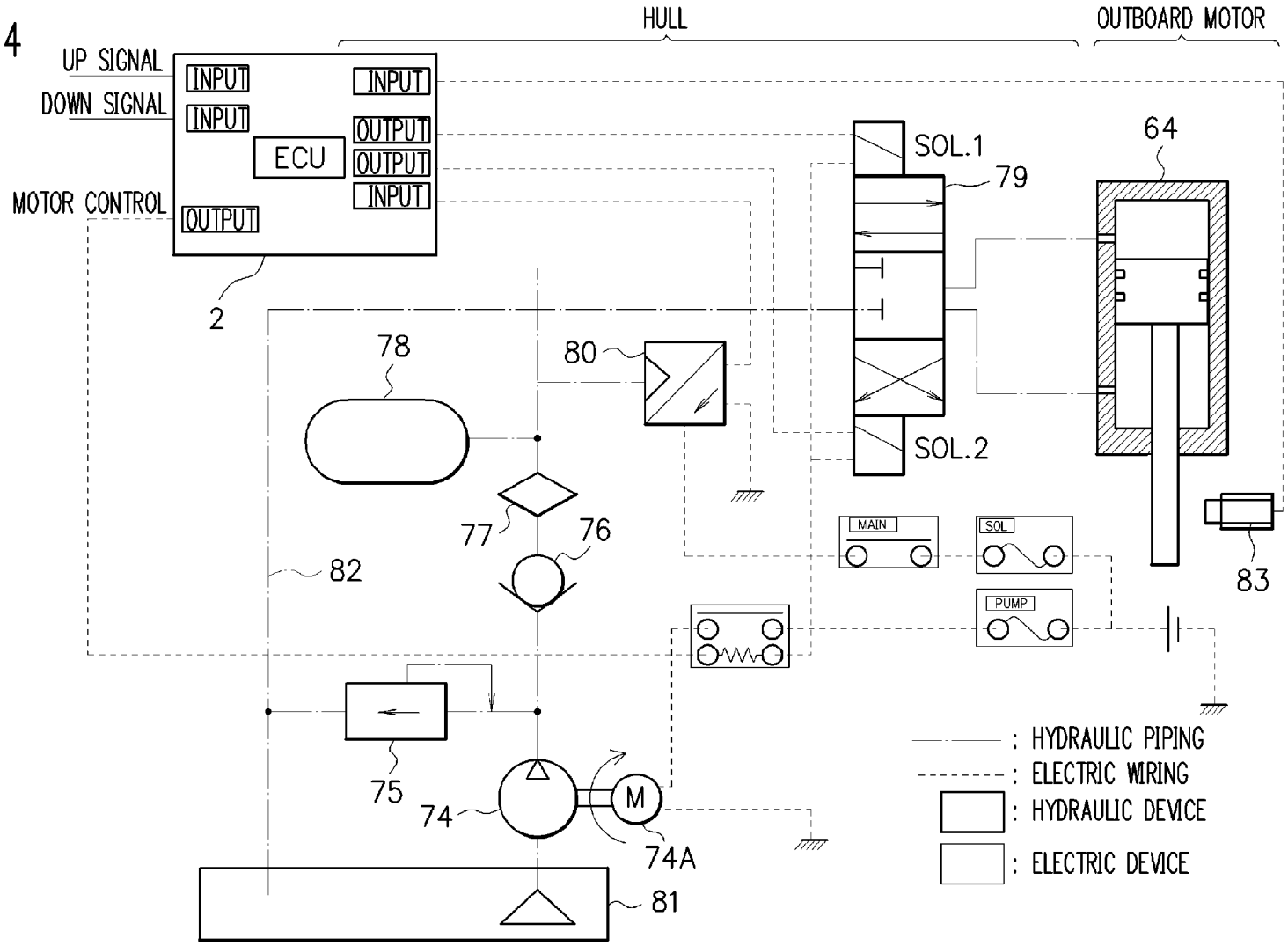
FIG. 14 is a block diagram illustrating a structural example of the transmission in the outboard motor according to the present invention.

FIG. 14 illustrates an overall structural example of the drive device 63. In the hydraulic system including the hydraulic cylinder 64, a hydraulic pump 74 driven by an electric motor 74A, a regulator 75 performing hydraulic adjustment, a one-way valve 76, a filter 77, an accumulator 78, a solenoid valve 79, a hydraulic sensor 80, and a reservoir tank 81 are connected as illustrated via a hydraulic piping 82. These component members are mounted on the hull side, and the solenoid valve 79 and the hydraulic cylinder 64 are connected via the hydraulic hose 69 as described above. The solenoid valve 79 and so on are actuated and controlled by an ECU (Engine Control Unit) 2 provided on the hull side. A stroke sensor 83 is attached to the hydraulic cylinder 64, this stroke sensor 83 detects at least an operating stroke end of the hydraulic cylinder 64, and a detection signal thereof is sent to the ECU 2. Note that as illustrated in FIG. 1, a steering device 3, a remote control device 4, and so on are disposed on an operator's seat of the boat 1, and according to operations of them, the drive device 63 is controlled via the ECU 2.

Next, characteristic operation and effect of the transmission 33 in the outboard motor 10 of the present invention will be described. First, in the basic operation of the transmission 33 of the above-described structure, the dog clutch 60 is moved upward from the neutral position of FIG. 9 by, for example, the shift fork 67 via the slide yoke 65 by actuating the hydraulic cylinder 64. In this case, the dog clutch 60 is engaged with the main drive gear 45, the drive shaft input shaft 22A and the drive shaft output shaft 22B are directly coupled via the main drive gear 45 and the dog clutch 60, and the transmission 33 shifts to the high shift speed. On the other hand, when the solenoid valve 79 is switched to actuate the hydraulic cylinder 64 in a direction reverse to the above described direction, the dog clutch 60 moves downward from the neutral position of FIG. 9. In this case, the drive shaft input shaft 22A and the drive shaft output shaft 22B are connected at the speed reducing ratio R via the gear train 39. By thus sliding the dog clutch 60 up and down in the transmission 33, it is possible to appropriately slide to the high shift speed and the low shift speed.

In the present invention, in particular, with the drive device 63 of the dog clutch 60 being constituted of the hydraulic drive device driven by the hydraulic cylinder 64, control of shifting in the transmission 33 can be performed easily. Note that by providing the transmission 33 in middle of the drive shaft 22, power performance, fuel consumption performance, and the like can be improved. Further, since the hydraulic cylinder 64 is disposed in the transmission chamber 37, there is no concern that the hydraulic cylinder 64 is exposed to sea water, and thus durability of the device can be improved largely.

Further, in the transmission 33 illustrated in FIG. 11 or the like, the drive shaft 22 is disposed in the center portion in the left and right direction of the forefront part of the transmission chamber 37, and the counter shaft 38 and the hydraulic cylinder 64 are offset to left and right, respectively, behind the drive shaft 22 and disposed in a triangle shape.

Being in the above-described disposition relation, the drive shaft 22 of the outboard motor 10 is provided close to the support shaft 19 as a steering shaft pivoting the outboard motor 10 left and right (see FIG. 3), and by disposing these three in triangle as described above, the drive shaft housing 16 in which the drive shaft 22 is housed can be formed compactly. Further, since the drive shaft housing 16 and the steering shaft can be disposed more closely, inertial moment of the outboard motor 10 decreases, and a maximum steerable angle thereof can be secured largely, thereby improving controllability of the boat 1.

Further, the dog clutch mechanism 40 of the transmission 33 is structured to switch between a high shift speed and a low shift speed by the dog clutch 60 sliding up and down, and a lower engagement position of the dog clutch 60 is set to the low shift speed.

The dog clutch 60 of the transmission 33 slides in the vertical direction on the shaft of the transmission 33 extending in the vertical direction. The hydraulic cylinder 64 driving this dog clutch 60 decreases in hydraulic pressure when the outboard motor 10 stops. To the hydraulic cylinder 64 decreased in hydraulic pressure, the weight of the dog clutch mechanism 40 or the like operates and the dog clutch 60 moves downward. In such cases, when the lower engagement position of the dog clutch 60 is set to the low shift speed, it is already moved to the low shift speed when the outboard motor 10 is started again, and hence it is not necessary to check the shift position of the transmission 33 every time it is started, which excels in usability and handleability, and the like.

Further, the hydraulic drive device has the electric hydraulic pump 74, and the electric hydraulic pump 64, an electromagnetic changeover valve, and so on excluding the hydraulic cylinder 64 are disposed on the hull side outside the outboard motor 10.

With respect to these component members, it is not necessary to provide a mounting place inside the outboard motor 10, and thus the outboard motor 10 can be structured compactly.

Further, in the dog clutch mechanism 40 of the transmission 33, in the structure in which the dog clutch 60 moves to the upper engagement position and the lower engagement position via the slide yoke 65, the detent device 70 can be disposed which retains the moving position of at least the slide yoke 65 to the upper engagement position.

Since the slide yoke 65 of the dog clutch mechanism 40 is retained to the engagement position of the dog clutch 60 with the detent device 70, it is unnecessary to constantly apply hydraulic pressure to the hydraulic cylinder 64, and the operating frequency of the hydraulic pump 74 can be made small. This consequently improves fuel consumption of the outboard motor 10.

Further, each gear of the gear train 39 is constituted of a helical gear, where the twist angle of the helical gear is set so that a thrust reactive force operating on the mutually engaged main drive gear 45 and counter driven gear 47 and a thrust reactive force operating on the mutually engaged main driven gear 46 and counter drive gear 48 counter each other.

A thrust load operating on the counter shaft 38 is canceled out, and thus it is not necessary to provide thrust bearing means on the bearing rotatably supporting the counter shaft 38. This simplifies the bearing device, and friction resistance of the bearing due to the thrust load decreases, thereby improving fuel consumption efficiency of the outboard motor 10.

In the foregoing, the present invention has been described together with various embodiments, but the present invention is not limited only to these embodiments. Changes and the like can be made within the range of the present invention.

In the above-described embodiments, an example of forming the detent device 70 retaining the slide yoke 65 to the upper engagement position is described, but it is also possible to dispose a similarly structured detent device to the lower engagement position.

According to the present invention, since the drive device of the dog clutch is constituted of the hydraulic drive device, control of shifting in the transmission can be performed easily. Further, since the hydraulic cylinder is disposed in the transmission chamber, there is no concern that the hydraulic cylinder is exposed to sea water, and thus durability of the device can be improved largely.

Further, by devising the disposition relation of the drive shaft, the counter shaft, and the hydraulic cylinder in the transmission chamber, the drive shaft housing can be formed compactly. Moreover, corresponding to this, inertial moment of the outboard motor decreases, and the maximum steerable angle can be secured largely, resulting in effects such as improving controllability of the boat thereby.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A transmission of an outboard motor in which a crank shaft extending in a vertical direction of an engine mounted on an upper side is coupled to a drive shaft, a gear transmission capable of switching between at least two high and low speed ratios is interposed between a drive shaft input shaft coupled to the crank shaft and a drive shaft output shaft driving a propeller, which are separated into an upper part and a lower part of the drive shaft, wherein:

the transmission is housed in a transmission chamber formed in a drive shaft housing and comprises the drive shaft, a counter shaft disposed in parallel with the drive shaft, a gear train bridged between each of the drive shaft input shaft and output shaft and the counter shaft, and a dog clutch mechanism selectively switching a high shift speed and a low shift speed;

the transmission comprises a drive device driving the dog clutch mechanism constituted of a hydraulic drive device driven by a hydraulic cylinder, the hydraulic cylinder being disposed in the transmission chamber; and the drive shaft is disposed in a center portion in a left and right direction of a forefront part of the transmission chamber, and the counter shaft and the hydraulic cylinder are offset to left and right, respectively, behind the drive shaft and disposed in a triangle shape in a plan view.

2. The transmission of the outboard motor according to claim 1, wherein the dog clutch mechanism of the transmission is structured to switch between the high shift speed and the low shift speed by a dog clutch thereof sliding up and down, and a lower engagement position of the dog clutch is set to the low shift speed.

3. The transmission of the outboard motor according to claim 1, wherein the hydraulic drive device has an electric hydraulic pump, and component members including the hydraulic pump and an electromagnetic changeover valve excluding the hydraulic cylinder are disposed on a hull side outside the outboard motor.

4. The transmission of the outboard motor according to claim 1, wherein the dog clutch mechanism of the transmission is structured such that a dog clutch thereof moves to an upper engagement position and a lower engagement position via a slide yoke, and a detent device is provided which retains a moving position of at least the slide yoke to the upper engagement position.

5. The transmission of the outboard motor according to claim 1, wherein:

each gear constituting the gear train is constituted of a helical gear; and a twist angle of the helical gear is set so that thrust reactive forces operating on gears meshing between the drive shaft input shaft and the counter shaft and on gears meshing between the drive shaft output shaft and the counter shaft counter each other.

* * * * *